United States Patent [19]

Harris et al.

[11] Patent Number: 4,700,653

[45] Date of Patent: Oct. 20, 1987

[54] SUBMARINE WEAPON HANDLING SYSTEM

[75] Inventors: Robert M. Harris, New Hope; Arthur G. Blomquist, Plymouth, both of Minn.

[73] Assignee: FMC Corporation, Chicago, Ill.

[21] Appl. No.: 846,434

[22] Filed: Mar. 31, 1986

[51] Int. Cl.[4] ..... B63G 8/28; B63G 8/30; B63G 8/32

[52] U.S. Cl. ..... 114/316; 114/318; 114/238; 89/34

[58] Field of Search ..... 114/238, 316, 318, 319; 89/45, 34, 1.801, 1.805, 1.7; 414/745

[56] References Cited

U.S. PATENT DOCUMENTS 3,228,295 1/1966 Kane et al. ..... 89/45
3,249,011 5/1966 Wermager et al. ..... 414/745 X
3,276,317 10/1966 Kossan et al. ..... 89/1.7 X

*Primary Examiner*—Sherman D. Basinger
*Attorney, Agent, or Firm*—A. J. Moore; H. M. Stanley; R. B. Megley

[57] ABSTRACT

A submarine weapon handling system and method includes a storage tray, ramming tray, and transfer tray. Each tray has a plurality of rotatable bands received in grooves in the trays and are movable between an open weapon receiving position and a closed weapon clamping position. The storage tray and ramming tray are stationary and the transfer tray is movable. The transfer tray is moved into contact with a weapon secured in the storage tray, the bands of the transfer tray are rotated around the weapon, and the bands in the storage tray are rotated from closed to open position permitting the transfer tray to move a selected weapon into the bands of the ramming tray which are then rotated into weapon clamping position while the bands of the transfer tray are opened permitting the transfer tray to be moved away from the ramming tray.

30 Claims, 22 Drawing Figures

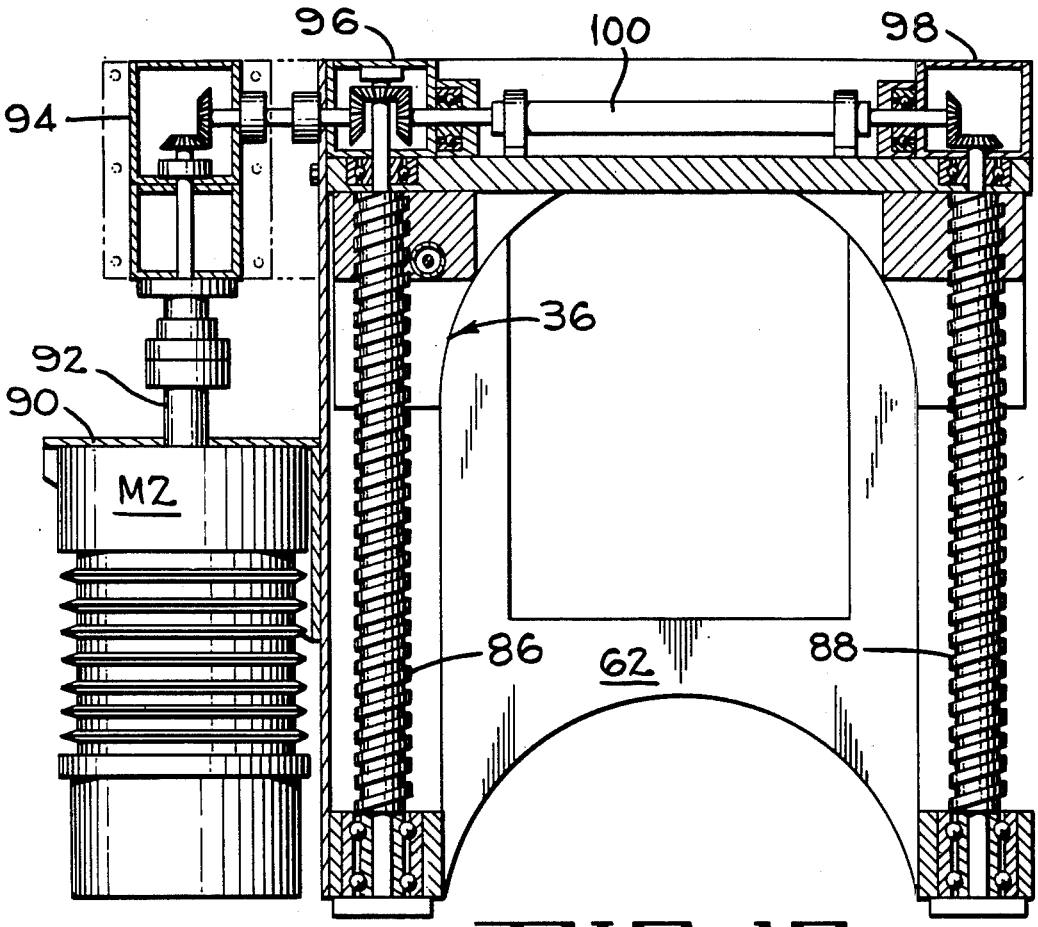
FIG_12
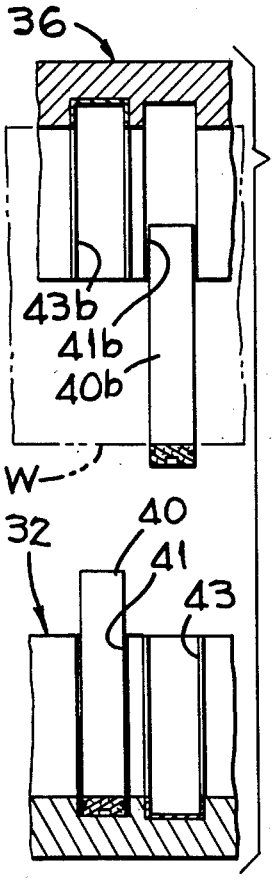
FIG_13
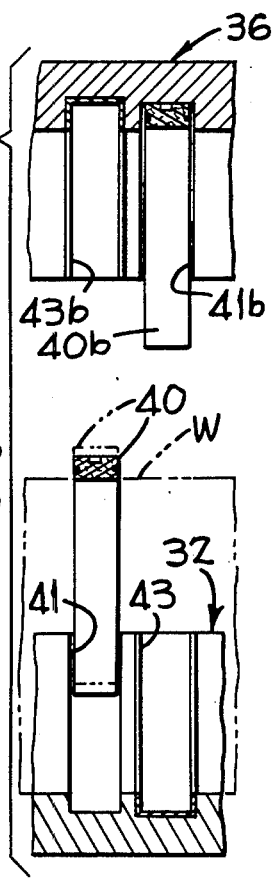
FIG_16
FIG_14 FIG_15
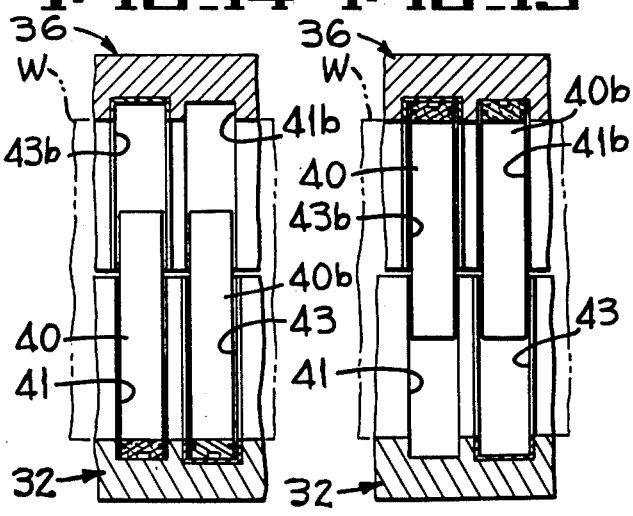

SUBMARINE WEAPON HANDLING SYSTEM

BACKGROUND OF THE INVENTION

1. Field of the Invention

The present invention relates to submarine weapon handling systems, and more particularly relates to such systems which include a plurality of weapon storage trays associated with at least one launching tray and at least one transfer tray for transferring selected weapons between the storage trays and the launching tray or trays.

2. Description of the Prior Art

Weapon handling systems currently being used in submarines for handling weapons such as torpedoes, mines, and missiles or the like, use a plurality of dollies to secure a plurality of weapons to the submarine and to transport the weapons along tracks for transfer into a selected ramming tube. Four dollies are usually provided for each weapon and each dolly is moved by conventional power assist means in the submarine. When the weapon is to be used, the selected dollies and attached weapon are moved into position on the loading tray to be loaded into a torpedo tube, the dollies are unclamped from the weapon and the weapon is rammed into the tube. However, each weapon dolly is of two piece construction which includes a dolly body and a lashing strap, which strap must be handled manually and which body and strap must be stowed as separate pieces when not in use.

SUMMARY OF THE INVENTION

In accordance with the present invention a plurality of weapon storage trays are provided in the submarine for receiving and storing weapons such as torpedoes, mines and missiles within the submarine. At least one vertically and transversely movable transfer tray is provided for loading a weapon into each storage tray, and for thereafter picking a preselected weapon from one of the storage trays and transferring it to a ramming tray for ramming it into a torpedo or launching tube or the like. Each weapon storage tray, each weapon transfer tray and each weapon ramming tray includes an arcuate, generally semicylindrical weapon engaging surface. A plurality of arcuate weapon clamping bands are provided for each tray, and each band is movably supported in an arcuate recess in its tray for movement between an open weapon receiving position and a weapon clamping position. When the bands are clamped in their weapon clamping position, the weapon may be supported upon the associated tray, or may be suspended from the bands of the associated tray.

BRIEF DESCRIPTION OF THE DRAWINGS

FIG. 12 is a section taken along lines 12—12 of FIG. 6 illustrating the drive components for moving one end of the transfer tray vertically.

FIG. 13 is an operational view in central longitudinal section through the transfer tray and ramming tray illustrating the position of one band in each tray with a weapon being suspended by the band in the transfer tray.

FIG. 14 is similar to FIG. 13 but with both trays being in abutting contact with the weapon with the transfer tray band closed around the weapon and with the ramming tray band being open.

FIG. 15 is similar to FIG. 14 but with ramming tray clamp secured to the weapon and the transfer tray band being open, portions of both bands being received in slots in the opposed tray.

FIG. 16 is similar to FIG. 15 but having the weapon secured to the ramming tray by the ramming tray band and the transfer tray being spaced from the ramming tray with its band in open position, said ramming tray band being shown in its relaxed position in phantom lines.

DESCRIPTION OF THE PREFERRED EMBODIMENT

Figure 1:
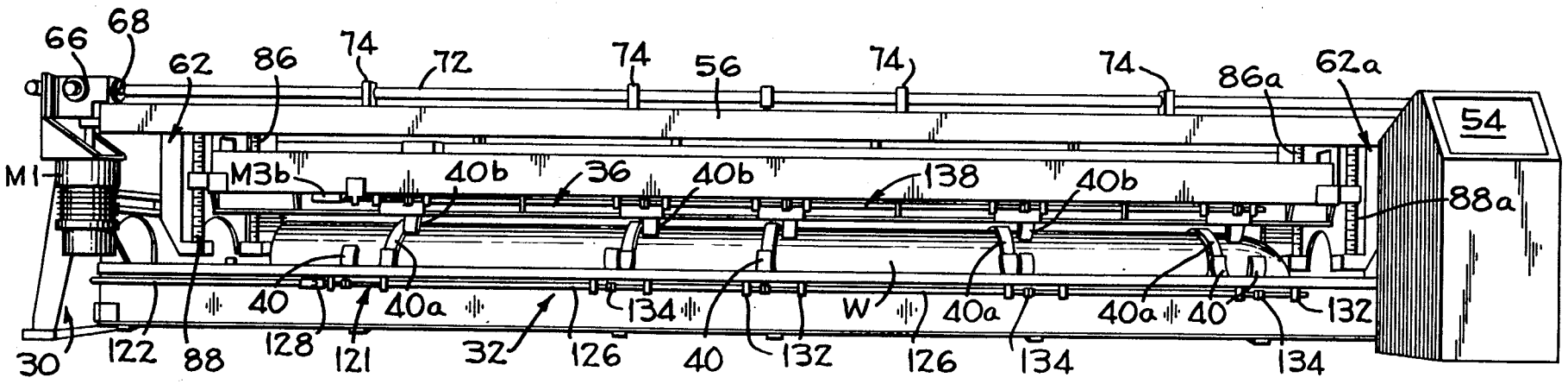
FIG. 1 is a perspective of the weapon handling system of the present invention in its simplest form illustrating the basic components of the invention with a weapon clamped to a storage tray.

In general, the weapon handling system 28 (FIGS. 1–4) of the present invention comprises a pair of similar end supporting mechanisms **30,30*a* to which a plurality of ramming trays 32 (only one being shown in FIGS. 2 and 5), and a plurality of weapon storage trays 34 (only one being shown) are rigidly secured. A plurality of transfer trays 36 (only one being shown in FIG. 4) are supported by the end support mechanisms 30,30*a* for both vertical and horizontal movement. Each of the trays 32,34 and 36 has a generally arcuate surface for receiving a generally semicylindrical surface of a elongated weapon W therein. After a selected weapon W has been placed in one of a plurality of ramming trays 32, it is rammed into a conventional torpedo or launching tube 38 (FIG. 4**) for subsequent launching at a target.

A plurality of arcuate weapon securing bands **40,40*a* and 40*b*** are slidably received in arcuate slots or recesses 41,41*a* and 41*b* (FIGS. 13–15) in the arcuate surfaces of the associated ramming tray 32, weapon storage tray 34, and the transfer tray 36, respectively. Each of the trays is preferably formed from lightweight composite material contained within a steel frame thereby substantially reducing the weight of the system of the present invention. The end portions of each band project outwardly of the associated tray when in stowed position as illustrated by bands 40 in FIGS. 1–3 and 13 thereby being positioned to receive a weapon W. The bands 40,40*a* are spaced from the weapon within the recessed slots of trays 32,34 when the weapon is in firm engagement with the associated upwardly opening arcuate portions of these trays. When the weapon W is to be secured to the associated trays by bands 40,40*a* and 40*b* the associated bands are driven around the unsupported portions of the weapon W until only the end portion of the bands remain in the associated slots of their associated trays, which end portions are positioned in clamping engagement with the associated trays and with the weapon. When two trays such as ramming tray 32 and transfer tray 36 are moved together into transfer position as shown in FIGS. 14 and 15, portions of the bands 40 of tray 32 are received in arcuate recesses 43*b* in tray 36; and portions of bands 40*b* are received in arcuate recesses 43 in ramming tray 32. Clamping mechanisms 42,42*a* and 42*b* (FIGS. 5 and 9) in the form of wedges 44 received in tapered slots 46,46*a* (FIG. 2) in the associated bands 40,40*a*,40*b* rigidly secure the weapon to the associated trays. The weapon may be supported in an upwardly opening tray, such as ramming tray 32 at which time the associated bands 40 are secured over the weapon as shown in FIG. 4; or the weapon may be supported by the bands 40*b* and be firmly held against the downwardly opening transfer tray 36 as best shown in FIG. 2.

Figure 10:
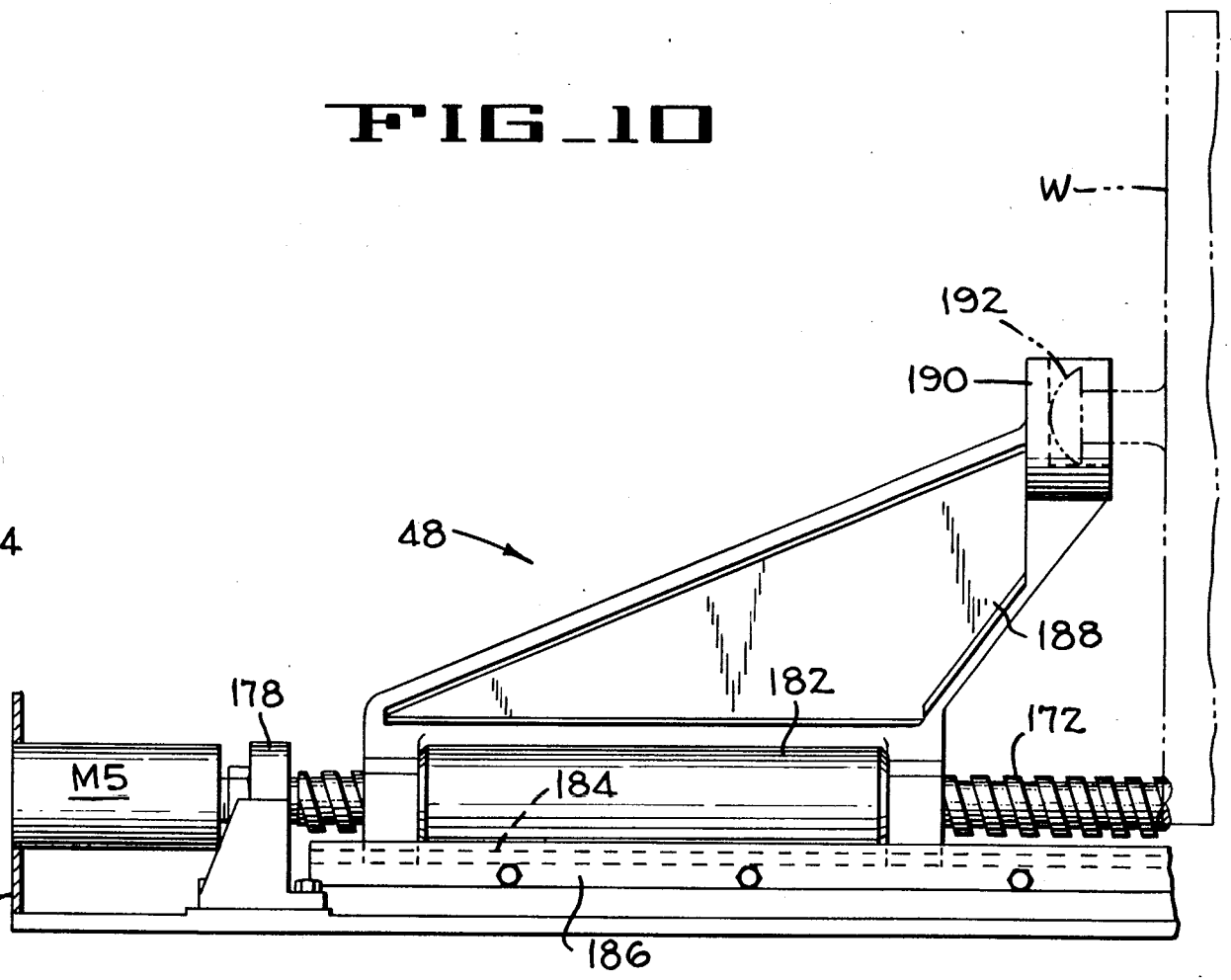
FIG. 10 is a side elevation illustrating a fragment of the weapon ramming mechanism, a portion of the weapon being shown in phantom.

When a weapon W is to be loaded into a launching tube 38 (FIG. 4), a ramming mechanism 48 (FIGS. 2 and 10) is actuated to push the weapon W axially out of the ramming tray 32 and into the launching tube 38 (FIG. 4) at which time the bands 40 of the ramming tray are relaxed from the weapon, as illustrated in phantom in FIG. 16, but are retained over the weapon to prevent the weapon from rolling out of the arcuate surface of the ramming tray 32 due to high seas or nearby explosions yet permitting the weapon to be rammed out of the tray 32 and into the launching tube 38.

Figure 2:
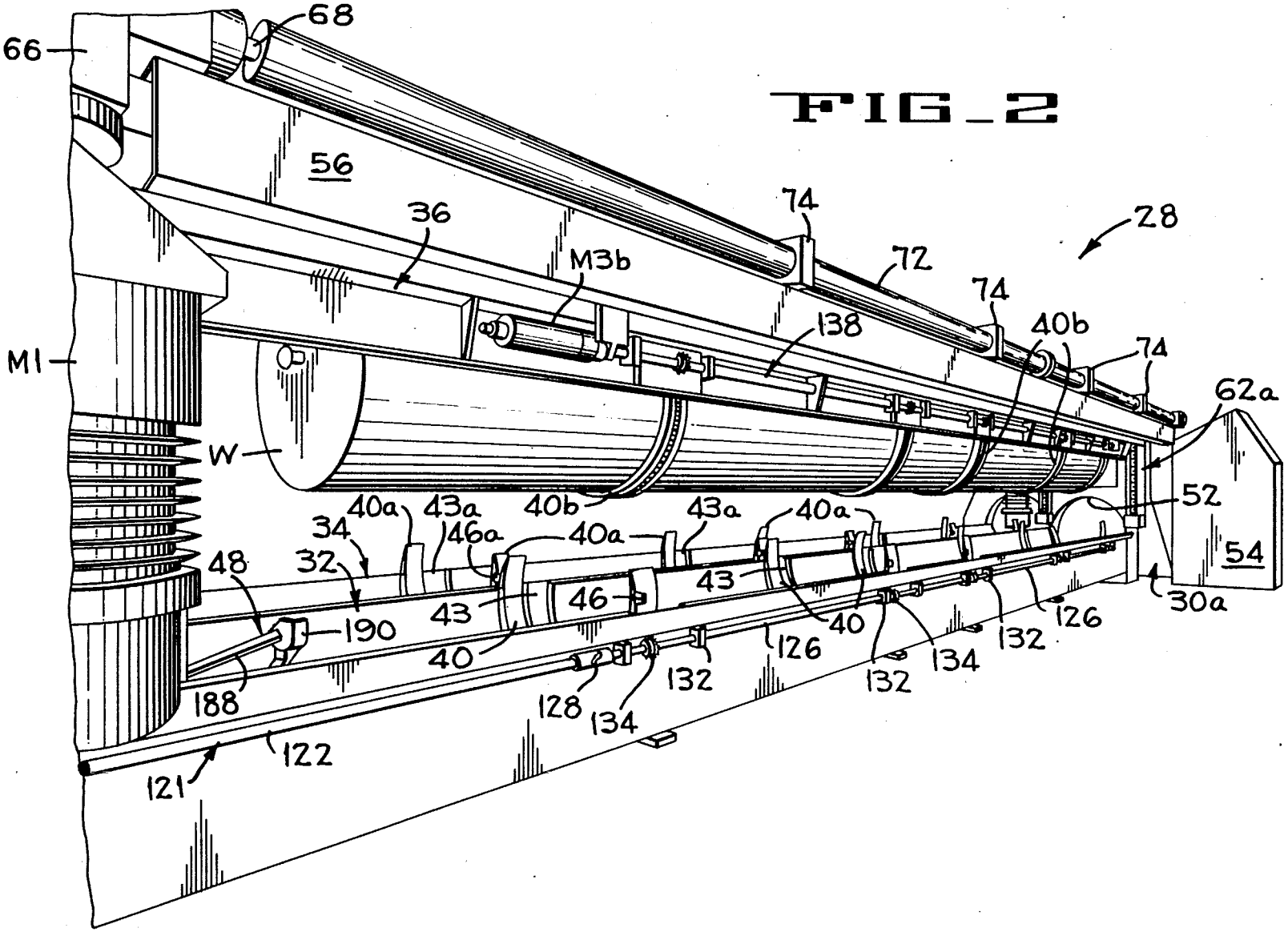
FIG. 2 is an enlarged perspective of the apparatus of FIG. 1 shown in a different operative position, the weapon being suspended by bands clamped to a transfer tray and disposed above the ramming tray.
Figure 3:
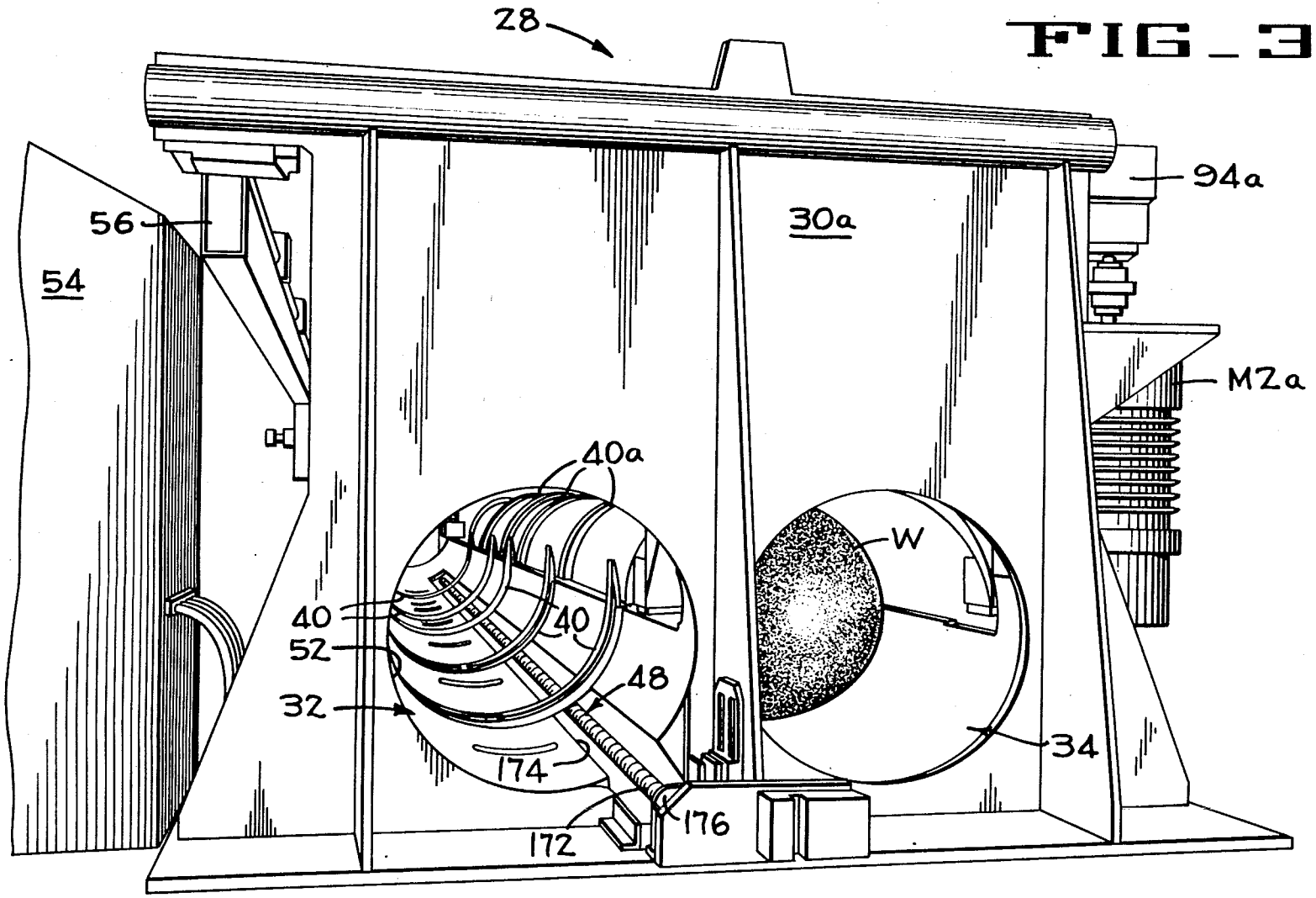
FIG. 3 is an enlarged end perspective illustrating the weapon clamped in a storage tray by associated bands, and illustrating a plurality of bands in recesses in the ramming tray in their open positions and further illustrating the weapon ramming screw in a recess formed in the ramming tray.
Figure 4:
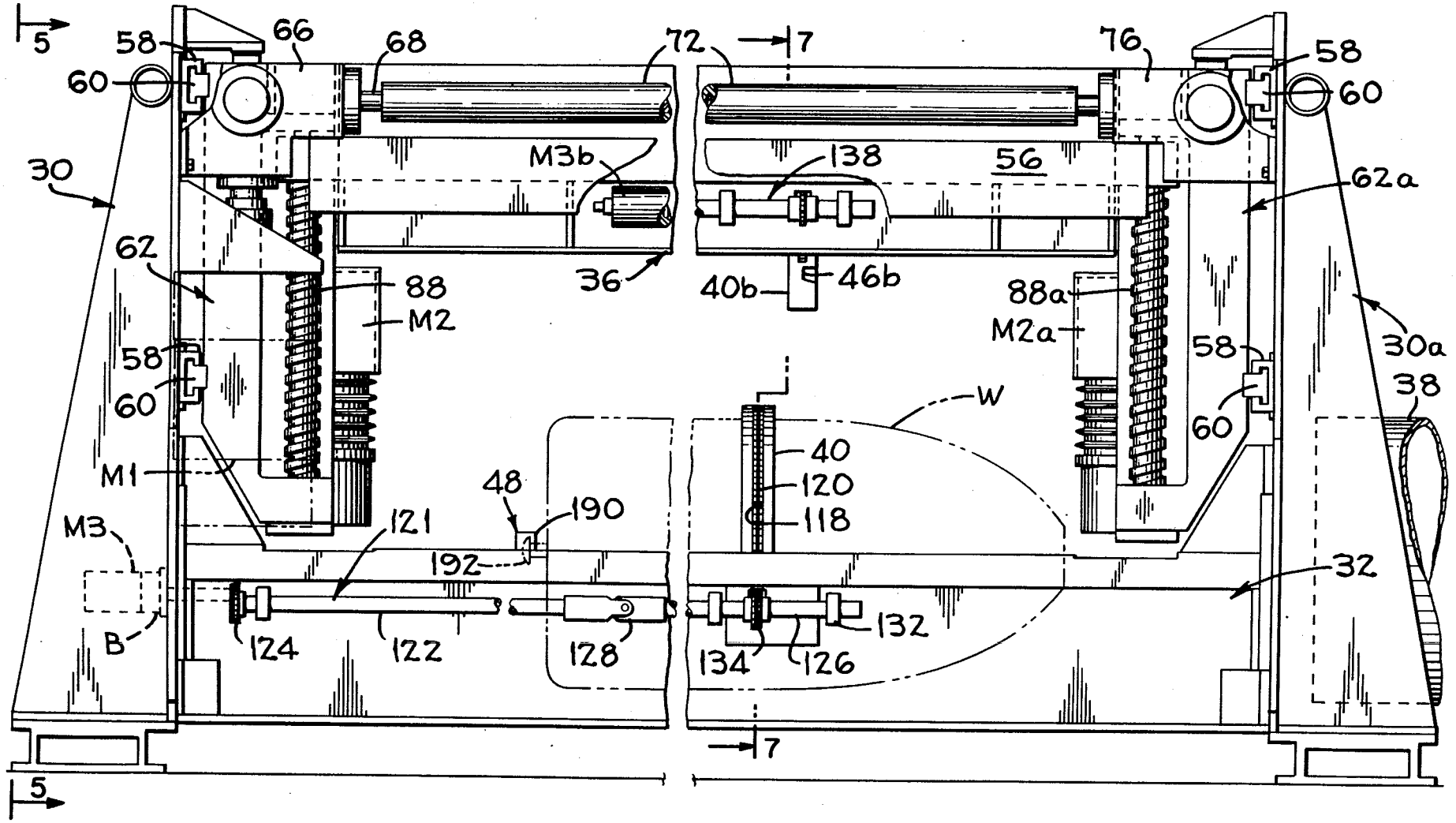
FIG. 4 is a side elevation with parts cut away illustrating certain operative components of the weapon handling system.

More particularly, the end support mechanisms 30,30*a* are rigidly secured the hull of a submarine (not shown) with the end supporting mechanism 30*a* being adjacent the input end of one of the torpedo or launching tubes 38 (only one being shown in FIG. 4). An opening 52 (FIGS. 2 and 3) in the end support mechanism 30*a* is in alignment with the longitudinal axes of the launching tube 38 and the ramming tray 32 thus permitting ramming of the weapon W into the launching tube 38. An operator's control panel 54 (FIG. 1) is connected to the support mechanism 30*a* and includes conventional controls for operating the several power units incorporated in the weapon handling system 28. The two end support mechanisms 30,30*a* are rigidly secured to each other by the ship's hull, by the trays 32,34 and by upper horizontal beams 56, only one being shown.

Figure 5:
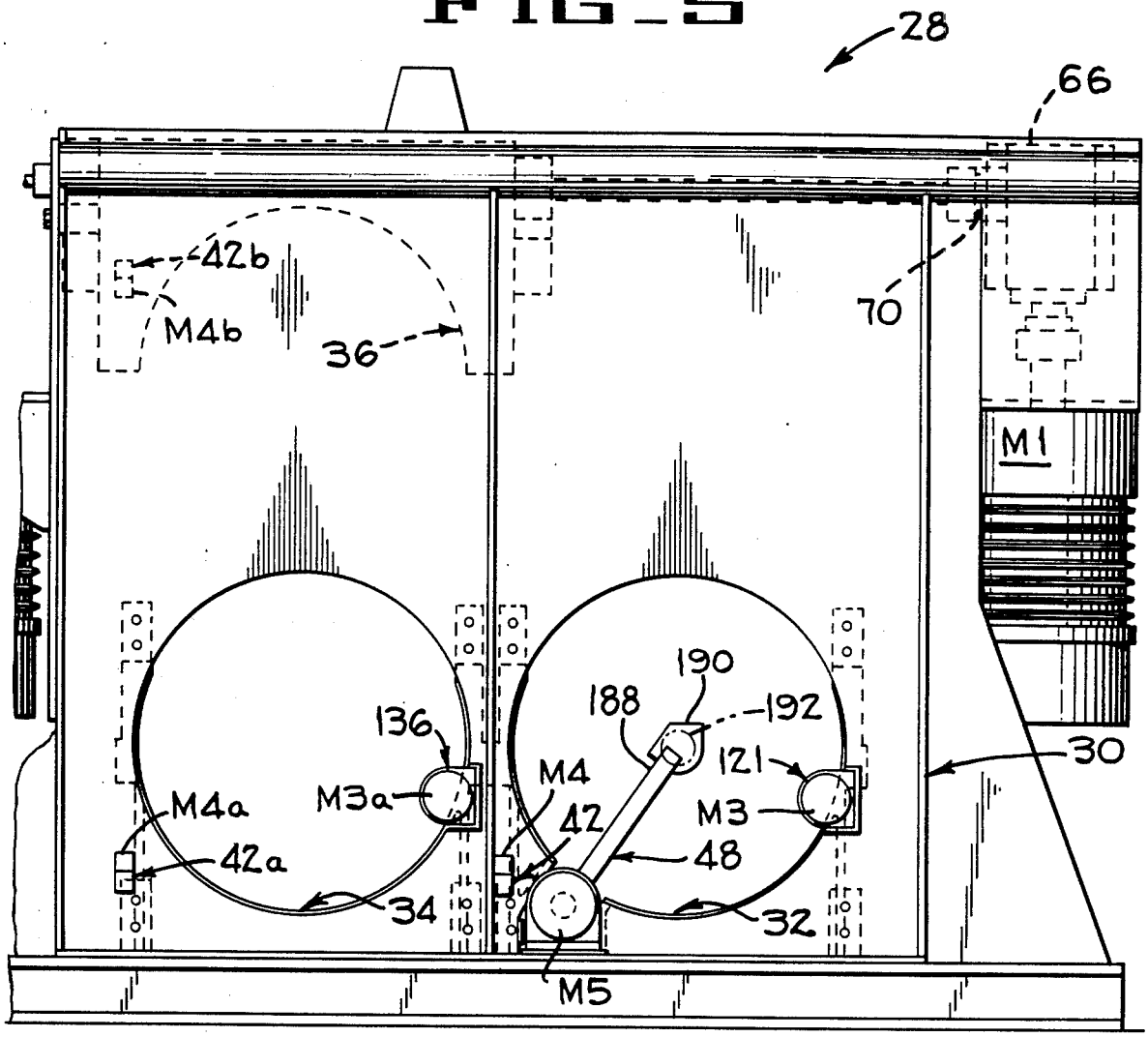
FIG. 5 is an end elevation of FIG. 4 looking in the direction of arrows 5—5 of FIG. 4.
Figure 6:
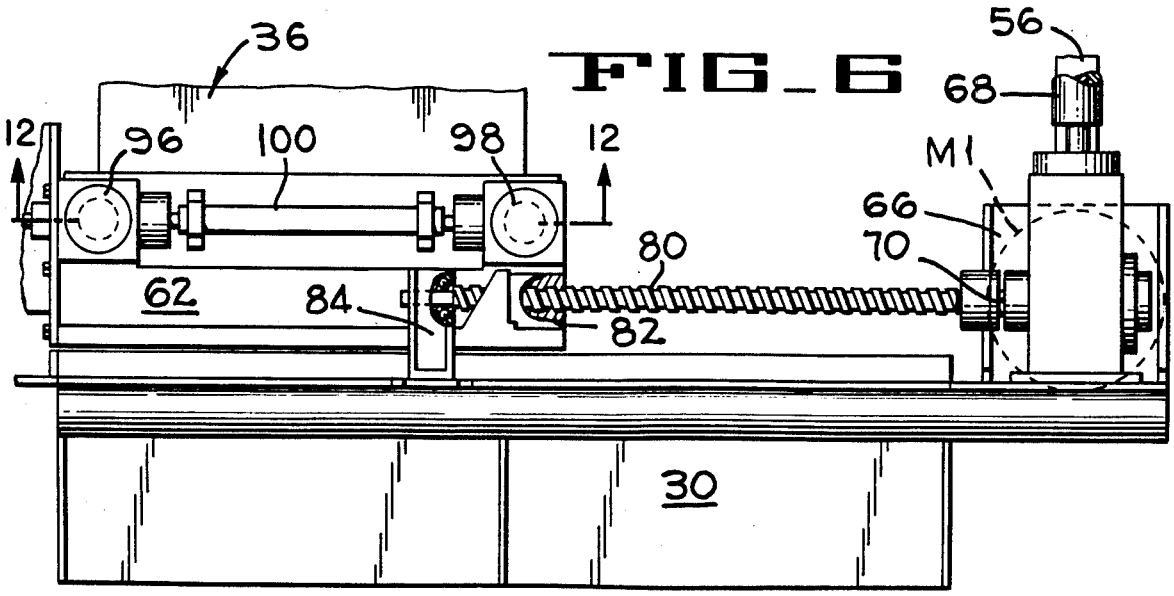
FIG. 6 is a top plan of the input end of the apparatus looking in the direction of arrows 6—6 of FIG. 4.
Figure 7:
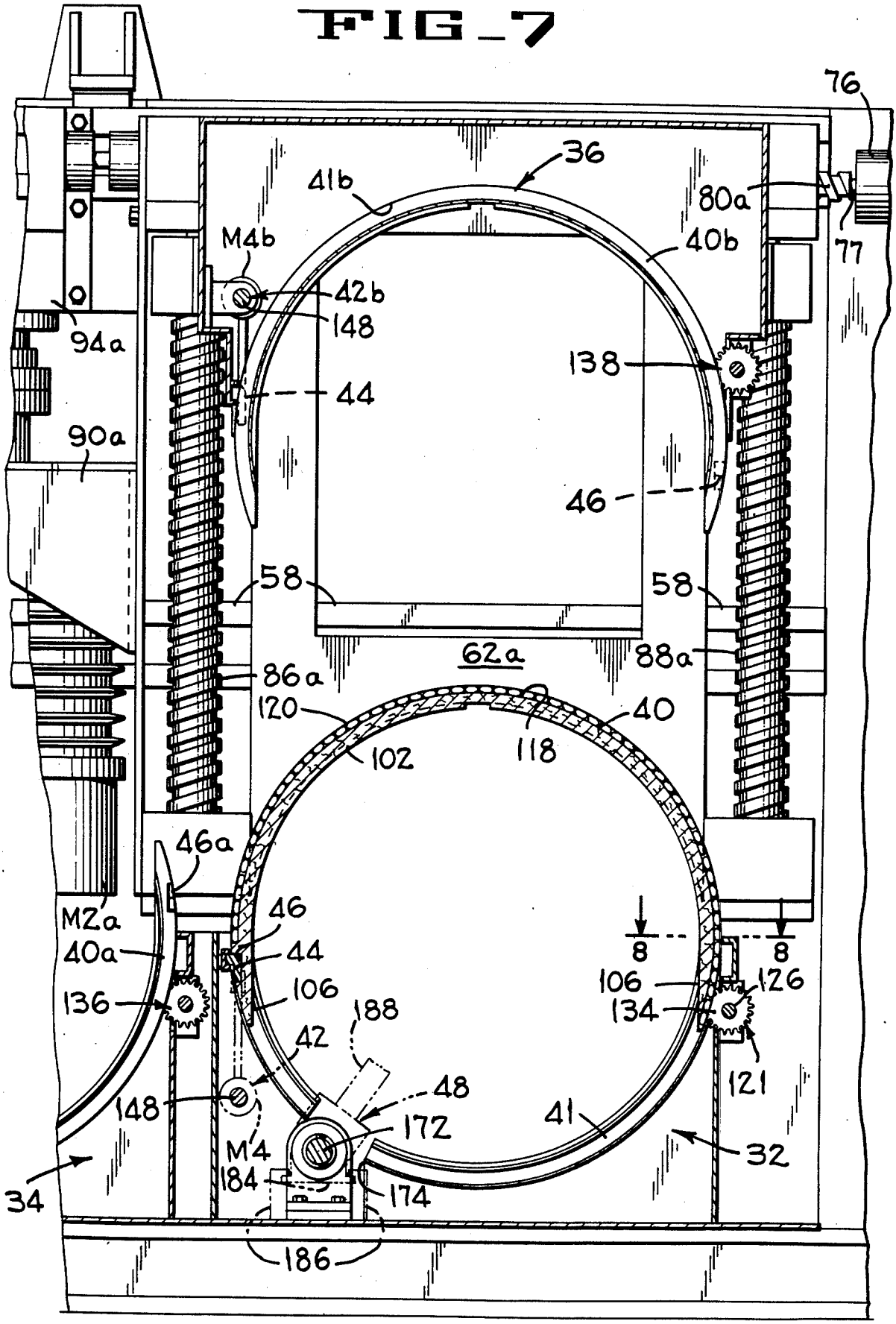
FIG. 7 is a section taken along lines 7—7 of FIG. 4 illustrating the structure for rotating the bands.

As best shown in FIGS. 4 and 7, each end supporting mechanism 30,30*a* includes a pair of spaced transversely extending T-slotted guide rails 58 (FIG. 4) which receive T-bars 60 that are rigidly secured to a pair of opposed carriages 62,62*a*. The carriages 62,62*a* are driven transversely of the weapon handling system in timed relation to each other by power means, preferably an electric motor M1 (FIG. 1), which is rigidly secured to the end support mechanism 30. The output shaft of the motor M1 is coupled to a gear box 66 secured to the end supporting mechanism 30 and has two output shafts 68 and 70 (FIGS. 2, 5 and 6). The output shaft 68 is coupled to an elongated torsion shaft 72 (FIG. 2) having small diameter end portions and a large diameter intermediate portion journaled to one of two longitudinally extending beams 56 by bearings 74. The other end of the torsion shaft 72 is coupled to an input shaft of a gear box 76 (FIG. 7) having an output shaft 77 that is similar to output shaft 70 of FIG. 6 which is directed transversely of the weapon handling system 28.

The output shaft 70 (FIG. 6) of the gearbox 66 is coupled to an elongated transversely extending screw 80 which is journaled on the end support mechanism 30 and is threaded into a block 82 that is secured in driving engagement to the adjacent carriage 62. The free end of the screw 80 is journaled in a bearing in a bracket 84 on the end support mechanism 30. The transverse output shaft 77 (FIG. 7) of the other gear box 76 is likewise connected to a transverse screw 80*a* that is similar to the screw 80 thereby simultaneously driving the two carriages 62,62*a* and attached transfer tray 36 transversely of the weapon handling system 28 in the same direction and at the same speed in response to an operator closing a control on the control panel 54.

As best shown in FIGS. 4 and 12, the carriage 62 has a pair of elongated vertically extending screw 86,88 therein. The carriage 62 has a motor M2 (FIG. 12) secured thereto by bracket 90. An output shaft 92 of the motor M2 drives a first gear box 94 which drives a second gear box 96 and a third gear box 98 through a shaft 100.

Since the weapons W are quite heavy, the other end of the transfer tray 36 is raised and lowered by a second reversible motor M2*a* (FIGS. 3 and 7) that is supported on the carriage 62*a* by bracket 90*a*. The motor M2*a* drives a gear box 94*a* which drives a pair of vertically extending elongated screws 86*a*,88*a* (FIGS. 1 and 7) which are journaled in the carriage 62*a* and are driven by a drive train similar to that described in regard to screws 86 and 88. Thus, when the operator actuates conventional controls in the control panel 54, the two reversible motors M2,M2*a* are driven to raise and lower the transfer tray 36 with or without a weapon clamped thereto by the weapon securing bands 40*b* (FIG. 2).

The weapon securing bands 40,40*a* and 40*b* are of substantially the same design and are operated in substantially the same way. Having reference to FIGS. 4 and 7–9, each band 40 of the ramming tray 32 comprises a semicylindrical body 102 which is slidably received in the arcuate slots 41 in the ramming tray 32 when in their stowed position. The end portions of each band 40 project outwardly from the semicylindrical body and have their inner surfaces beveled at 106 (FIG. 7) to permit the weapon W to enter or be removed from the tray. After the bands 40 have been rotated around the weapon W in the ramming tray 32 and after the transfer tray 36 is lowered into weapon transferring position on the weapon W in the ramming tray 32, portions of the bands 40 of the ramming tray 32 (FIG. 14) are received in arcuate slots 43*b* in the transfer tray 36; and the bands 40*b* of the transfer tray 46 are received in arcuate slots 43 in the ramming tray. Similarly, when the transfer tray 36 is moved into weapon transferring positioning on top of the weapon W in the storage tray 34, the bands 40*b* of the transfer tray 36 enter arcuate slots 43*a* (FIG. 2) in the storage tray 34 and the bands 40*a* of the storage tray 34 enter the arcuate slots 43*b* in the transfer tray 36.

Figure 8:
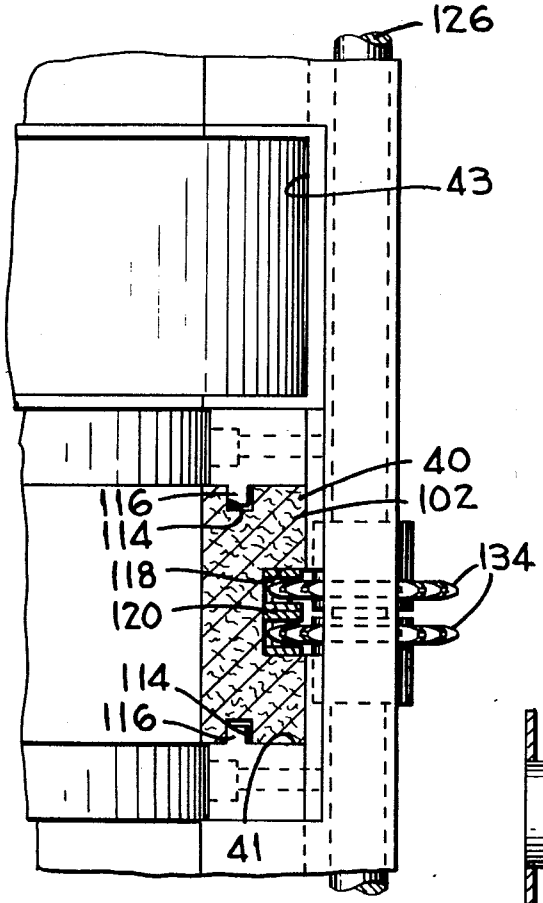
FIG. 8 is a section taken along lines 8—8 of FIG. 7.
Figures 9, 11:
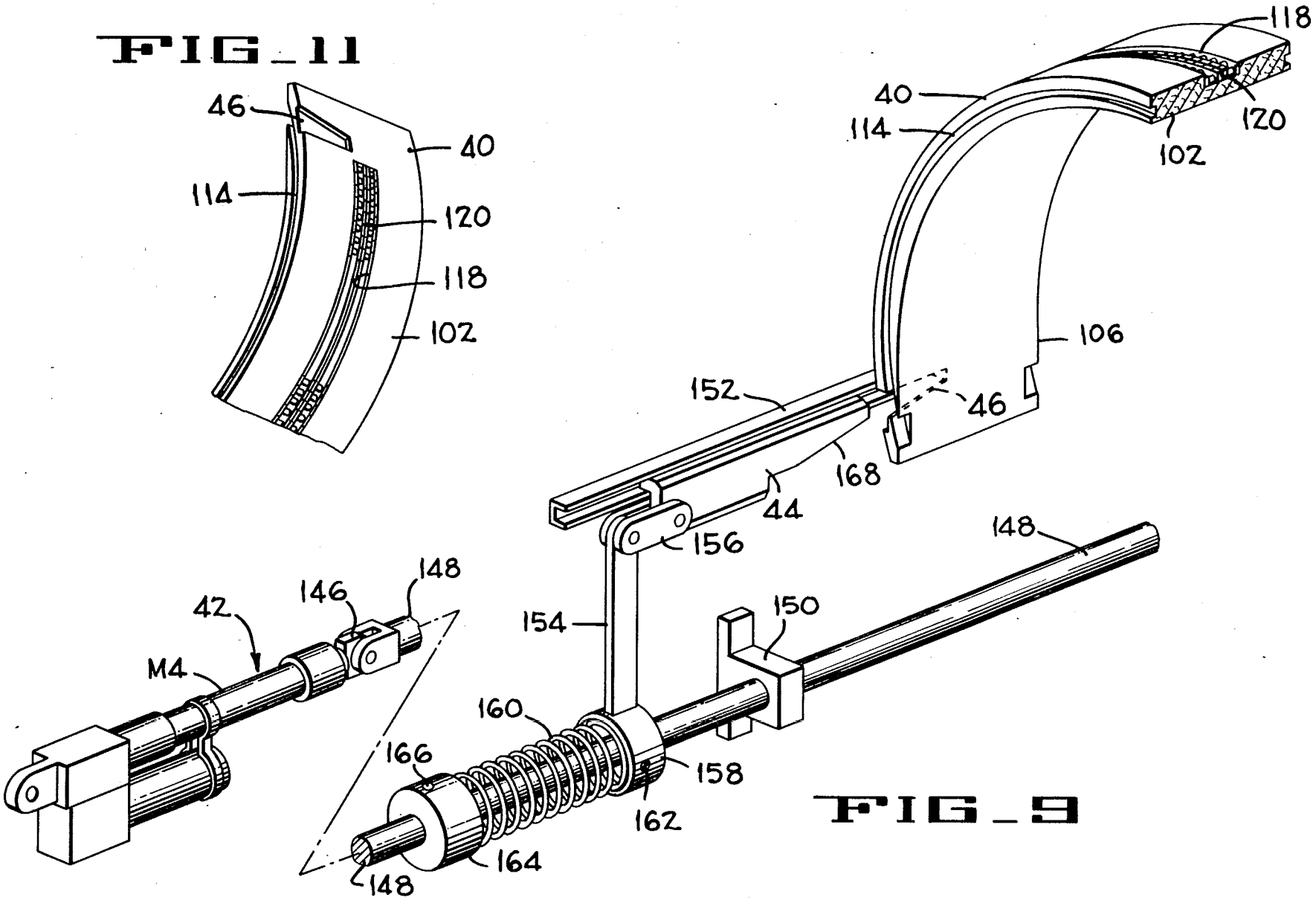
FIG. 9 is a perspective with parts cut away illustrating the mechanism for locking the bands in weapon securing position.
FIG. 11 is a fragment of one end portion of a band illustrating a locking slot therein.

As best shown in FIGS. 8, 9 and 11, each band is provided with arcuate slots 114 in its side walls which slidably engage arcuate guides 116 secured to the associated trays 32,34 and 36 as by bolting, which slots and guides serve to guide the bands along an arcuate path between their open and closed positions. Each band has a central arcuate recess 118 (FIGS. 9 and 10) formed in its outer periphery within which a segment of a drive chain 120 is rigidly secured.

The weapon securing bands 40 of the ramming tray 32, five being illustrated in FIG. 1, are simultaneously driven by a band drive system 121 which includes a reversible motor M3 (FIG. 4) having a spring set magnetically released brake B therein. The motor M3 is secured to the end support mechanism 30 and is connected to an inlet shaft 122 by a speed reducing drive 124. The inlet shaft 122 is coupled to one or more inline shafts 126 by a universal joint 128 while the inline shafts 126 are supported for rotation on the ramming tray 32 by bearings 132. Five sprockets 134 are secured to the inline shaft 126 in position to mesh with the chain segments 120 secured within the recesses 118 on the exterior arcuate surfaces of the bands 40. Thus, when an operator actuates certain controls on the consul 54 (FIG. 1) the motor M3 is energized to release the brake B and is driven in one direction which will rotate all five weapon securing bands 40 from the open position illustrated in FIG. 2 to the weapon clamping position illustrated in FIG. 4; and when driven in the opposite direction the bands 40 will be moved from the clamping position to the open position of FIG. 2.

The drive system 136 for the weapon securing bands 40*a* of the storage tray 34 is substantially the same as that used to drive the bands 40 except that an independently controlled reversible motor M3*a* (FIG. 5) with a spring set mechanically released brake (not shown) is used to drive the bands 40*a* between their open and closed positions in response to controls in the control panel 54 being actuated.

Similarly, the bands 40*b* of a drive system 138 (FIGS. 2 and 7) for the transfer tray 36 are driven between their open and closed position by a motor M3*b* having a spring set-magnetically released brake thereon. The remainder of the drive system 138 is substantially the same as that of the system 121 except that the entire system including the motor M3*b* is supported on the horizontally and vertically movable transfer tray 36. Also, it will be noted that the system 138 is driven in a clockwise direction when moving the bands 40*b* from their stowed position to their weapon clamping position whereas the bands 40 and 40*a* are rotated counterclockwise when moving between their stowed and clamping positions.

The previously mentioned clamping mechanisms 42 (FIG. 9) and wedges 44 which are received in the tapered slots 46 of the band 40 are best shown in FIGS. 5, 7, 9 and 11. Having reference to FIG. 9, the clamping mechanism 42 associated with the ramming tray 32 comprises a reversible motor M4 which is preferably an electrically driven motor. The motor M4 is secured to the ramming tray 32 (FIG. 7) and reciprocates a plunger 146 (FIG. 9) that is connected to and reciprocates an elongated rod 148, only a portion being shown, which rod may be formed from several interconnected sections. The rod 148 is slidably connected to the ramming tray 32 by a plurality of bearings 150 (only one being shown) and extends to all weapon securing bands 40 that are slidably received in the ramming tray 32. The wedge 44 associated with the illustrated band 40 is formed from an angle bar and is slidably received in a track 152 secured to the ramming tray 32. The rear end of the wedge 44 is pivotally connected to an arm 154 by a link 156. The arm is connected to a shouldered collar 158 which is slidably received on the rod. One end of a spring 160 is secured to the collar 158 by a set screw 162, and the other end of the spring is similarly connected to a second collar 164 that is rigidly secured to the rod 148 by pin 166. The function of the spring 160 is to permit the motor M4 to move all five wedges 44 into their slots 46 in the associated bands 40 thereby tightening all bands against the weapon W.

When it is desired to lock the bands 40 on a weapon, the motor M4 is actuated to push a portion of the wedges fully into the tapered slots 46 in one end of the associated band, which slots extend approximately half of the width of the band. Each wedge 44 includes a flat upper surface (FIG. 9) and a tapered lower surface 168 which engages complementary surfaces of the slot 46 to firmly clamp the band 40 on the weapon W. At this time the other end of the band is locked by the brake B on the motor M3 of the band drive system 121 of ramming tray 32. When it is desired to ram the weapon W out of the ramming tray 32, the motor M4 is reversed to partially withdraw all wedges 44 from the slots 46 in all bands 40 thereby retaining the bands 40 over the weapon but releasing clamping pressure of the bands on the weapon which allows the weapon to be rammed into the launching tube while preventing the weapon from being accidentally dumped from the tray during ramming.

When it is desired to completely release all the bands 40, the motor M4 fully retracts all of the wedges from the slots 46 of the bands 40 as illustrated in FIG. 9 thus permitting the motor M3 to retract all bands 40 into their weapon receiving positions as shown in FIGS. 2 and 3.

The operation of the band locking mechanisms for each of the trays 32,34 and 36 will be briefly described in connection with one of the bands 40 (FIGS. 4, 9 and 11) of the ramming tray. The motor M3 (FIG. 4) is first energized which releases spring set brake B thereby driving the sprocket 134 on shaft 126 to rotate the band 40 from its retracted position (FIG. 1) to a position around the weapon W in the ramming tray. The motor M3 is then de-energized causing the brake B to lock one end of the band 40 in fixed position by engagement of the sprocket 134 with the chain 120. The reversible motor M4 (FIG. 9) is then actuated to move the wedge 168 into the tapered slot 46 thereby firmly clamping the weapon W to the ramming tray 32. When it is desired to ram the weapon out of the tray 32, the motor M4 is actuated to pull the wedge 168 partially out of the tapered slot 46 thereby restraining the weapon W as it is rammed out of the ramming tray 32.

The ramming mechanism 48 (FIGS. 2, 3, 5 and 10) is used to ram the weapon from the ramming tray 32 into the conventional torpedo or launching tube 38 (FIG. 4) after the clamping engagement of the bands 40 have been partially loosened as previously described.

The ramming mechanism 48 comprises an elongated ramming screw 172 (FIG. 3) which is recessed in a slot 174 in the composite material of the ramming tray 32. One end of the screw 172 is journaled in a bearing 176 while the other end is journaled in a bearing 178 (FIG. 10) and is driven by a reversible gear motor M5 secured to the end support mechanism 30. A conventional internally threaded carriage 182 rotatably receives the ramming screw 172 and includes a T-shaped foot 184 (FIG. 7) which is slidably received in tracks 186 in the slot 174. The carriage 182 includes upstanding arms 188 (FIGS. 2, 5 and 10) which includes a socket 190 that cradles a button 192 on the rear end of the weapon W when the weapon is lowered into the ramming tray 32.

In order to ram a weapon W into the launching tube 38 (FIG. 4) an operator actuates a control on the control panel 54 thereby causing the motor M5 to drive the screw 172 in a direction which pushes the weapon W out of the ramming tray and into the launching tube 38. Another control is actuated on the control panel 54 to reverse the motor M5 and return the carriage 182 to its weapon receiving position shown in FIG. 10 in a manner conventional in the art.

In describing the operation of the weapon handling system 28 of the present invention reference will be made to FIGS. 13–22. It will be assumed that the weapons W and W2 are clamped in one of a plurality of storage trays, such as storage tray 34 (FIGS. 17–22) by the weapon securing bands 40*a*, with the transfer tray 36 positioned over the storage tray 34 (FIG. 17) and with the bands 40 in the ramming tray 32 being opened and with the ramming mechanism 48 (FIG. 2) being retracted. It will also be assumed that it is desired to select a particular type of weapon W that is in storage tray 34 and move the weapon into the launching tube 38 (FIG. 4). It will further be understood that the plurality of conventional switches (not shown) in the control panel 54 are actuated by an operator in order to control the several motors.

Figure 17:
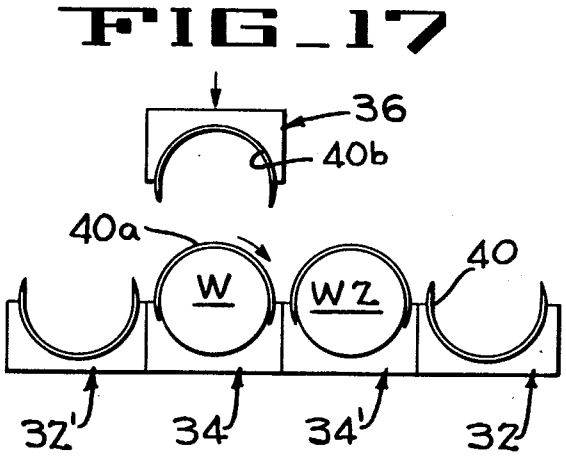
FIGS. 17–22 are transverse operational views through two storage trays, two ramming trays and a single transfer tray illustrating progressive steps in moving a selected weapon into ramming position in one of the ramming trays.
Figure 18:
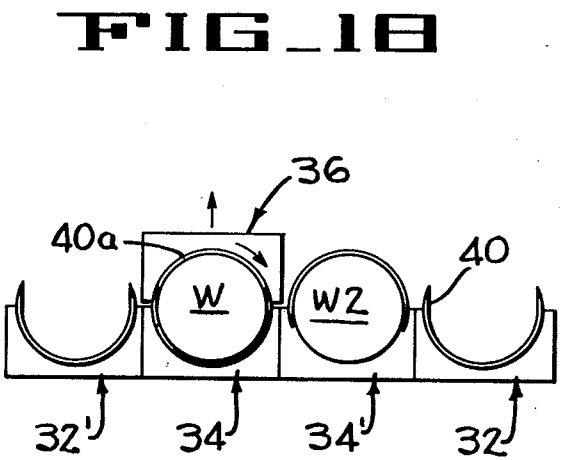
Figure 19:
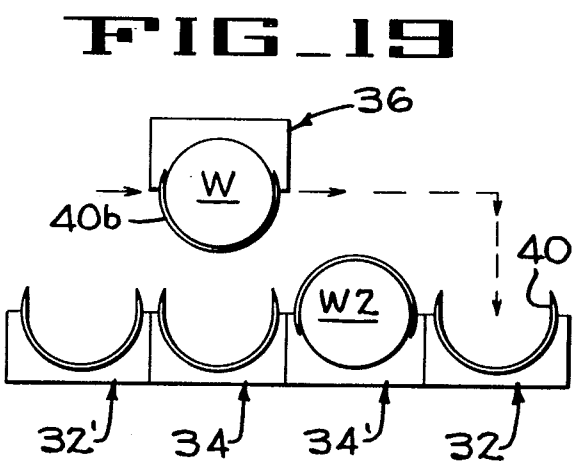
Figure 20:
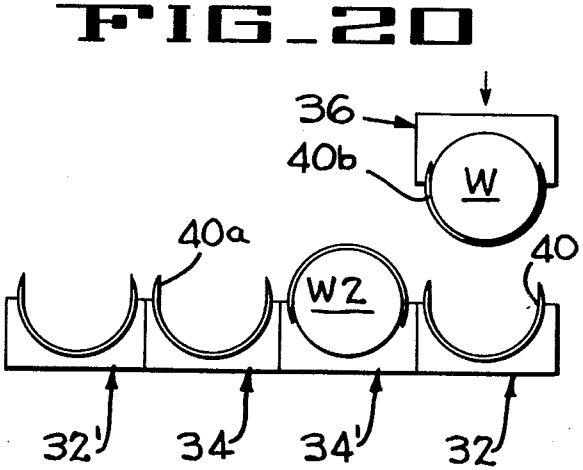
Figure 21:
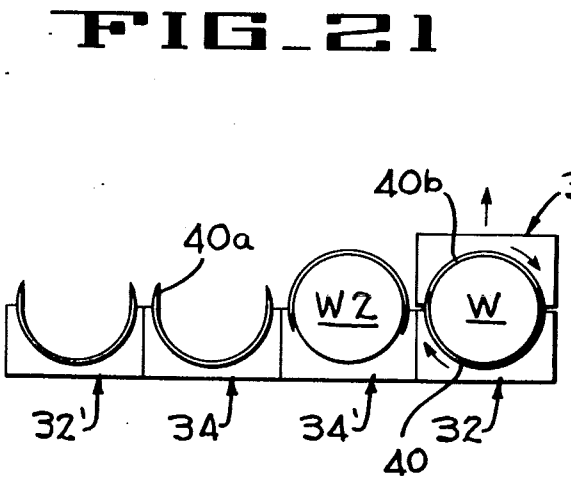
Figure 22:
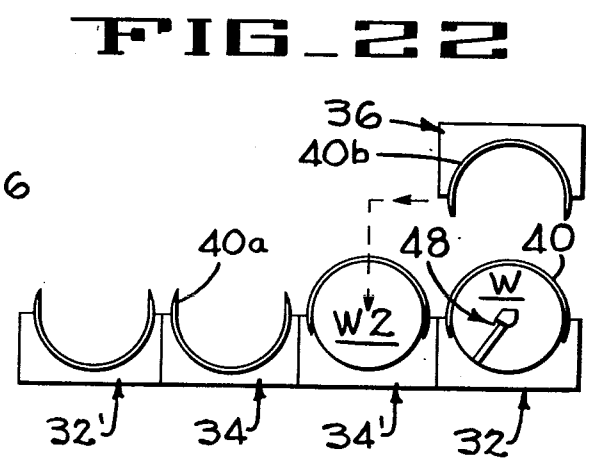

The operator first actuates switches to drive transfer tray elevating motors M2 and M2*a* in a direction which will lower the transfer tray 36 into abutting engagement with the weapon W in the storage tray 34 (FIG. 17). Another switch is then actuated to drive the wedge motor M4*a* (FIG. 5), which is similar to wedge actuating motor M4 (FIG. 9), in a direction which will unlock the wedges from all weapon retaining bands 40*a* in the storage tray 34. Other switches in the control panel 54 are then actuated to drive band drive motor M3*a* in a direction which rotates the bands 40*a* from their weapon clamping positions (FIG. 17) to their stowed positions (FIGS. 18, 19); and actuates the motor M3*b* (FIG. 2) to drive the bands 40*b* in the transfer tray 36 from the stowed positions to their weapon clamping positions under the weapon W. The wedge motor M4*b* (FIG. 7) is then driven by the switch which causes the wedges 44*b* to move into locking engagement in the slots 46*b* in the bands 40*b*. The weapon W is thereby locked to the transfer tray 36 and is released from the storage tray 34.

Switches in the control panel 54 are then actuated to energize motors M2 and M2*a* (FIG. 4) to elevate the transfer tray 36 and weapon W suspended from bands 40*b* to their raised position. After the tray is moved to its raised position, another switch in the control panel 54 is actuated to energize motor M1 in a direction which will move the transfer tray 36 and its suspended weapon W directly over the ramming tray 32 which has its bands 40 in their stowed open position for receiving the weapon W. The motors M2 and M2*a* are then energized by closing a switch in the control panel 54 which rotates screws 86,88 and 86*a*,88*a* in directions which will lower the weapon W into the open bands 40 (FIG. 21) of the ramming tray 32 until the transfer tray is fully lowered into weapon transfer position relative to the ramming tray 32 with the weapon seated within the ramming tray 32 and with the button 192 (FIG. 10) of the weapon seated in the socket 190 of the ramming mechanism 48. Wedge motor M4*b* (FIG. 5) is then energized by closing a switch in the control panel 54 which pulls the associated wedges (not shown) completely out of engagement with slots in the weapon securing bands 40*b*. The band drive motors M3 (FIG. 4) and M3*b* (FIG. 2) are then driven in directions which rotate the weapon securing band 40 into weapon securing position in the ramming tray 32 and rotate the bands 40*b* in the transfer tray 36 to their open positions thereby releasing the weapon W and the ramming tray 32. The wedge motor M4 (FIG. 9) is then actuated by a switch in the control panel 54 which moves the wedges 44 into locking engagement in the slots 46 in the bands 40. At this time the motor M3 (FIG. 4) is deenergized which causes the spring set-magnetically released brake B on motor M3 to lock the other ends of all bands 40 in fixed position.

When it is desired to push the weapon W into the launching tube 38, a switch in the control panel is actuated to energize the wedge motor M4 to partially withdraw the wedges 44 (FIG. 9) out of the tapered slots 46 in the bands 40 thus preventing the weapon from being accidentally dislodged from the ramming tray 32 but permitting the weapon to be moved longitudinally of the tray. The ramming motor M5 (FIG. 10) is then energized by closing a switch in the control panel 54 thereby rotating screw 172 and pushing the weapon W into the launching tube 38 (FIG. 4).

If the wrong type of weapon W has been loaded into the ramming tray 32, the above described operation may be reversed under control of switches in the panel 54 and the weapon W is returned to and clamped in one of a plurality of storage trays 34 (only one being shown) and the appropriate weapon is removed from another storage tray 34' (FIGS. 17–22) and delivered to the ramming tray 32 or a second ramming tray 32' as above described.

Several different types of weapons may be used in the weapon handling system of the present invention such as torpedoes, mines and missiles.

From the foregoing description it is apparent that the weapon handling system of the present invention is ideally suited for use in submarines. The system is capable of moving different types of weapons between one or more storage trays to one or more ramming trays by means of one or more transfer trays in response to an operator's input to a control panel. The storage trays, transfer trays and ramming trays each include a set of arcuate weapon securing bands which are driven around the weapon between an open position for receiving the weapon and a closed position for clamping the weapon to an associated tray. When it is desired to transfer a weapon from one tray to another, the two trays are moved into engagement with opposite sides of the weapon with the bands seated with slots in both trays. The bands that secure the weapon to one tray are then unlocked and rotated to an open position; and the bands in the other tray are rotated around said other tray and are locked to their tray to secure the weapon therein. One of the trays is then moved away from the other tray. When a weapon is received by a ramming tray, the bands are partially released so that the weapon may be rammed longitudinally of the tray out of the weapon handling system.

Although the best mode contemplated for carrying out the present invention has been herein shown and described, it will be apparent that modification and variation may be made without departing from what is regarded to be the subject matter of the invention.

What is claimed is:

1. A weapon handling system comprising:

means defining a weapon storage unit adapted to receive a weapon;

means defining a ramming unit for receiving a weapon to be launched;

means defining a transfer unit for transferring a selected weapon between a storage unit and said ramming unit;

means defining a plurality of bands in each unit movable between an open position for permitting a weapon to be transferred between associated units and a closed position clamping the weapon to an associated unit, and means for ramming the weapon when in said ramming unit longitudinally out of said ramming unit.

2. A system according to claim 1 and additionally comprising means defining a launching tube for receiving the weapon from said ramming unit.

3. A system according to claim 1 wherein said weapon storage unit and said ramming unit are in the form of elongated trays opening in a first direction, and wherein said transfer unit is in the form of an elongated tray opening in a direction opposed from said first direction.

4. An apparatus according to claim 3 wherein said weapon storage tray and said ramming tray open upwardly, and said transfer tray opens downwardly.

5. An apparatus according to claim 1 and additionally comprising means for relaxing said bands associated with said ramming unit to maintain lateral control of the weapon in said ramming unit while ramming the weapon out of said ramming unit.

6. An apparatus according to claim 1 and additionally comprising first arcuate slot means in said units for movably receiving said bands of said associated units; second arcuate slot means in each unit for movably receiving the bands from another unit when two units are simultaneously contacting a weapon in said two units; means for rotating the bands within said first arcuate slots between a weapon securing position and a weapon releasing position; means for rotating the bands of said another unit within said second arcuate slots between a weapon releasing position and a weapon securing position for securing the weapon to said another unit; and means for locking said bands of said another unit in clamping engagement with said another unit.

7. An apparatus according to claim 6 wherein said means for locking said bands includes tapered slots in said bands; and wedge means movable between a band locking position in said tapered slots and a position spaced from said tapered slots.

8. A weapon handling system comprising:

means defining a first weapon receiving unit adapted to receive a weapon and having a first plurality of grooves therein;

means defining a plurality of first bands received in said first grooves and movably secured to said first unit for movement between an open position for receiving a weapon and a closed position for securing the weapon to said first unit;

means defining a second weapon receiving unit adapted to receive the weapon and having a second plurality of grooves therein;

means defining a plurality of second bands received in said second grooves and movably secured to said second unit for movement between an open position for receiving a weapon and a closed position for securing the weapon to said second unit;

means defining band accommodating openings in said first and second units for loosely receiving portions of said second and first bands when said units are in abutting contact with the weapon; and means for moving said first bands between said closed positions to said open positions, and for moving said second bands from said open to said closed positions for releasing control of the weapon from said first unit to said second unit.

9. A system according to claim 8 wherein said first weapon receiving unit is a ramming unit having a concave weapon receiving surface facing upwardly, and wherein said second weapon receiving unit is a transfer unit having a concave weapon receiving surface facing downwardly.

10. A system according to claim 8 wherein said bands each have side walls with means defining arcuate slots therein, and wherein each of said grooves have arcuate guides attached thereto and received in associated ones of said arcuate slots for guiding said bands between said open and closed positions.

11. A system according to claim 8 wherein said first weapon receiving unit is a ramming unit and said second weapon receiving unit is a transfer unit; and additionally comprising means defining a third weapon receiving unit, means for moving said transfer unit along a first path for transferring a weapon from said ramming unit to said transfer unit, means for moving said transfer unit along a second path normal to said first path for positioning the weapon adjacent said third unit, and along a third path parallel to said first path for moving the weapon into said third unit.

12. A weapon handling system comprising: a first weapon receiving tray adapted to receive an elongated weapon therein and having a plurality of first and second arcuate grooves therein;

first spaced arcuate bands slidably received in said first grooves for movement between a weapon receiving position and a weapon clamping position;

a second weapon receiving tray adapted to receive a weapon therein and having a plurality of third and fourth arcuate grooves therein;

second spaced arcuate bands slidably received in said fourth grooves for movement between a weapon receiving position and a weapon clamping position;

first drive means for moving said first tray toward said second tray into weapon receiving position with said first bands being received in said third grooves in said second tray and with said second bands being received in said second grooves in said first tray.

13. A system according to claim 12 and additionally comprising second drive means for driving said first bands between said weapon receiving and weapon clamping position; and third drive means for driving said second bands between said weapon receiving and weapon clamping positions.

14. A system according to claim 13 wherein each of said bands has a pair of side walls with an arcuate slot therein, and wherein each of said first and fourth grooves have a pair of side walls with arcuate slides secured thereto and projecting into the associated arcuate slots for accurately guiding said bands between their weapon receiving and weapon clamping positions.

15. A system according to claim 14 and additionally comprising first locking means which includes a first tapered slot on one end of each of said first spaced bands, first wedge means disposed adjacent each of said first tapered slots, and means for reciprocating said wedges fully into each of said first tapered slots for rigidly locking said one end of said bands from movement relative to said first tray, said first wedges being partially retracted from said first tapered slots for maintaining lateral control of a weapon in said first tray but permitting the weapon to move longitudinally of the tray.

16. A system according to claim 15 and additionally comprising second locking means for locking the other ends of said first bands.

17. A system according to claim 16 wherein each of said first spaced artcuate bands has an outer wall and means defining a groove therein; said second drive means comprising a first reversible motor; a shaft connected to said motor; a chain segment rigidly secured to each of said first arcuate bands within said grooves in said first bands; and sprockets keyed to said shaft and being in driving engagement with an associated one of said chains.

18. A system according to claim 13 wherein each of said bands has an outer wall and means defining a groove therein; said second drive means comprising a first reversible motor; a shaft connected to said motor; a chain segment rigidly secured to each of said first arcuate bands within said slots in said first bands; and sprockets keyed to said shaft and being in driving engagement with associated ones of said chains.

19. A system according to claim 18 wherein said third drive means comprises a second reversible motor; a second shaft connected to said second motor; a second chain segment rigidly secured to each second arcuate bands within said slots in said second bands; and second sprockets keyed to said second shaft and being in driving engagement with an associated one of said chains.

20. A system according to claim 13 and additionally comprising first locking means for rigidly locking said first bands in weapon clamping position when a weapon is in said first tray; and second locking means for rigidly locking said second bands in weapon clamping position when a weapon is in said second tray.

21. A weapon handling system comprising;

an elongated stationary ramming tray adapted to receive a weapon, a plurality spaced ramming tray bands connected to said ramming tray, first power means for moving said ramming tray bands between an open weapon receiving position and a closed position securing a weapon to said ramming tray;

an elongated storage tray adapted to receive a weapon, a plurality of spaced storage tray bands connected to said storage tray, a second power means for moving said storage tray bands between an open weapon receiving position and a closed position securing a weapon to said storage tray;

an elongated transfer tray adapted to receive and transfer a weapon between said storage tray and said ramming tray, a plurality of spaced transfer tray bands connected to said transfer tray, third power means for moving said transfer tray bands between an open weapon receiving position and a closed position securing a weapon to said transfer tray;

fourth power means for selectively moving said transfer tray along a transverse path spaced from said ramming tray and storage tray between a spaced position in alignment with said storage tray and said ramming tray; and fifth power means for moving said transfer tray in either direction normal to said transverse path.

22. A system according to claim 21 wherein said transverse path is a substantially horizontal path.

23. A system according to claim 21 wherein said ramming tray and said storage tray are secured in fixed position relative to each other.

24. A system according to claim 21 and additionally comprising carriage means adjacent each end of said transfer tray, said fifth power means connecting said carriage means to said transfer tray for moving said transfer tray in either direction normal to said transverse path, and said fourth power means being connected to said carriage means and said transfer tray for moving said transfer tray along said transverse path.

25. A system according to claim 24 wherein a weapon is clamped in said storage tray and is to be moved to said ramming tray; said fourth power means being activated for moving said transfer tray along said transverse path in weapon transfer alignment with said storage tray; said fifth power means being actuated to move said transfer tray into abutting engagement with said weapon in said storage tray; said third power means being activated to move said transfer tray bands from an open position and a closed position securing the weapon to said transfer tray; said second power means being activated to move said storage tray bands from said closed to said open position thereby releasing the weapon; said fifth power means being activated to move the transfer tray and weapon away from said storage tray; said fourth power means being activated to move said weapon and said transfer tray in alignment with said ramming tray; said fifth power means being activated to move said weapon into abutting relationship in said ramming tray when said ramming tray bands are in said open position; said first power means being activated to move said ramming tray bands into said closed position securing the weapon to the ramming tray, actuating said third power means for moving said transfer tray bands into said open position; and activating said fifth power means for moving said empty transfer tray away from said ramming tray.

26. A system according to claim 25 and additionally comprising means for relaxing said ramming tray bands from weapon securing position while retaining the weapon encompassed within said ramming tray and ramming tray bands, and means for ramming the weapon longitudinally out of said ramming tray.

27. A weapon handling method including a plurality of weapon supporting units having a plurality of weapon securing bands in each of said unit and having a weapon in a first unit, comprising the steps of:

moving a plurality of first bands between an open position for receiving the weapon and a closed and locked position for clamping the weapon to said first unit;

moving a second unit into abutting contact with the weapon in said first unit;

retaining a plurality of of second bands in said second unit in an open position when said second unit is moving into contact with the weapon;

closing said second bands around the weapon in the second unit;

locking said second bands to said second unit for securing the weapon to said second unit;

unlocking the first bands from said first unit; and moving the second unit and weapon away from the first unit.

28. A method according to claim 27 wherein the first unit is a storage unit and the second unit is a transfer unit, and additionally comprising the steps of; first moving the second unit and weapon in a first direction away from the first unit, and thereafter moving the second unit and the weapon therein in a second direction normal to said first direction.

29. A method according to claim 28 wherein said first direction is substantially vertical and said second direction is substantially horizontal.

30. A method according to claim 28 wherein a ramming unit and ramming unit bands are provided and additionally comprising the steps of: moving the plurality of ramming unit bands between an open position for receiving the weapon and a closed position for clamping the weapon to a ramming unit, relaxing the clamping engagement of the ramming unit bands on the weapon while retaining the ramming unit bands secured to the ramming unit, and ramming the weapon longitudinally out of the ramming unit.

* * * * *